US011845626B2

(12) United States Patent
Chang

(10) Patent No.: US 11,845,626 B2
(45) Date of Patent: Dec. 19, 2023

(54) TAPE DISPENSER

(71) Applicant: CHUN NIEN PLASTIC LTD., Taichung (TW)

(72) Inventor: Chi-Tsai Chang, Taichung (TW)

(73) Assignee: CHUN NIEN PLASTIC LTD., Taichung (TW)

( * ) Notice: Subject to any disclaimer, the term of this patent is extended or adjusted under 35 U.S.C. 154(b) by 62 days.

(21) Appl. No.: 17/561,045

(22) Filed: Dec. 23, 2021

(65) Prior Publication Data

US 2022/0204305 A1 Jun. 30, 2022

(30) Foreign Application Priority Data

Dec. 25, 2020 (TW) ..... 109217094

(51) Int. Cl.
*B65H 35/00* (2006.01)

(52) U.S. Cl.
CPC ..... *B65H 35/0033* (2013.01); *B65H 35/008* (2013.01)

(58) Field of Classification Search
USPC ..... 242/422.4, 422.5, 588, 588.3
See application file for complete search history.

(56) References Cited

U.S. PATENT DOCUMENTS 2,678,777 A * 5/1954 Donkin ..... B65H 35/0026 225/25
2,889,975 A * 6/1959 Hanlon ..... B65H 35/0026 242/588.3
3,709,445 A * 1/1973 Adams ..... B65H 75/2245 242/422.5
5,759,342 A * 6/1998 Luhman ..... B65H 35/0026 156/577
6,152,398 A * 11/2000 Chen ..... B65H 35/0026 242/588
8,602,280 B2 * 12/2013 Chang ..... B26F 3/02 225/89
9,802,781 B2 * 10/2017 Kugimiya ..... B65H 35/0026
2002/0056526 A1 * 5/2002 Kelders ..... B65H 35/0033 156/577
2012/0091249 A1 * 4/2012 Crossett ..... B65D 85/04 206/397
2013/0214083 A1 * 8/2013 Yurczyk ..... A47K 10/38 242/588.3
2015/0266692 A1 * 9/2015 Tiedemann ..... B65H 37/005 156/577

FOREIGN PATENT DOCUMENTS

TW I486298 B 6/2015

* cited by examiner

*Primary Examiner* — William A. Rivera
(74) *Attorney, Agent, or Firm* — Muncy, Geissler, Olds & Lowe, P.C.

(57) ABSTRACT

A tape dispenser, including: a main body, including a base and a reel member, the reel member being connected to the base and movable between a plurality of positions relative to the base; an installation portion, connected to the main body, configured for installation of a tape; and a control portion, mounted to the base; wherein the control portion operates to allow movement of the reel member so that the reel member is switched to and restricted to be in one of the plurality of positions.

18 Claims, 7 Drawing Sheets

TAPE DISPENSER

BACKGROUND OF THE INVENTION

Field of the Invention

The present invention relates to a tape dispenser.

Description of the Prior Art

A tape dispenser is provided for mounting of a tape, and the tape dispenser generally includes a cutting portion for cutting the tape quickly. A conventional tape dispenser, such as one disclosed in TW 1486298, includes a base and a cutter, a core and a positioning ring, wherein the cutter is used to cut the tape. The cutter and the base are connected to each other by a sliding rail structure and are relatively slidable, so that the position of the cutter relative to the base can be adjusted.

However, it needs to hold the base of the conventional tape dispenser by one hand, it needs to move (pull or push) the cutter by another hand, and the cutter also has to be positioned by the hand(s). As a result, the cutter can slide relative to the base as the hand is let go of and moves the cutter to cut the tape, causing inconvenience in use.

The present invention is, therefore, arisen to obviate or at least mitigate the above-mentioned disadvantages.

SUMMARY OF THE INVENTION

The main object of the present invention is to provide a tape dispenser which can be controlled to be restricted in one of different positions.

To achieve the above and other objects, a tape dispenser is provided, including: a main body, including a base and a reel member, the reel member being connected to the base and movable between a plurality of positions relative to the base; an installation portion, connected to the main body, configured for installation of a tape; and a control portion, mounted to the base; wherein the control portion operates to allow movement of the reel member so that the reel member is restricted to be in one of the plurality of positions.

To achieve the above and other objects, a tape dispenser is provided, including: a main body, including a base and a reel member, the reel member being connected to the base and movable between a plurality of positions relative to the base; an installation portion, connected to the main body, configured for installation of a tape; and a control portion, mounted to the base; wherein the control portion operates to allow movement of the reel member so that the reel member is switched to and restricted between different neighboring ones of the plurality of positions.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
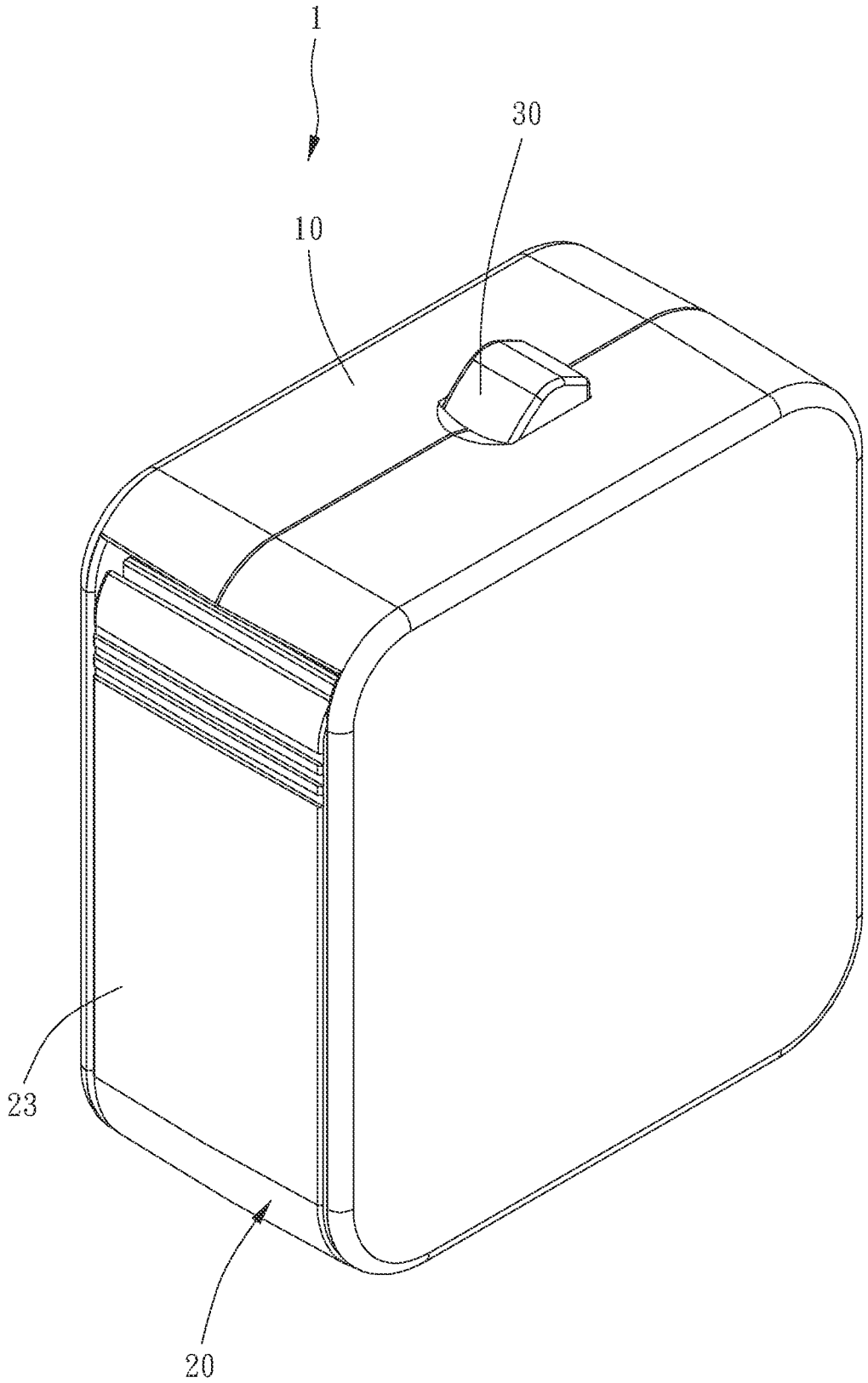
FIG. 1 is a stereogram of a preferable embodiment of the present invention.
Figure 2:
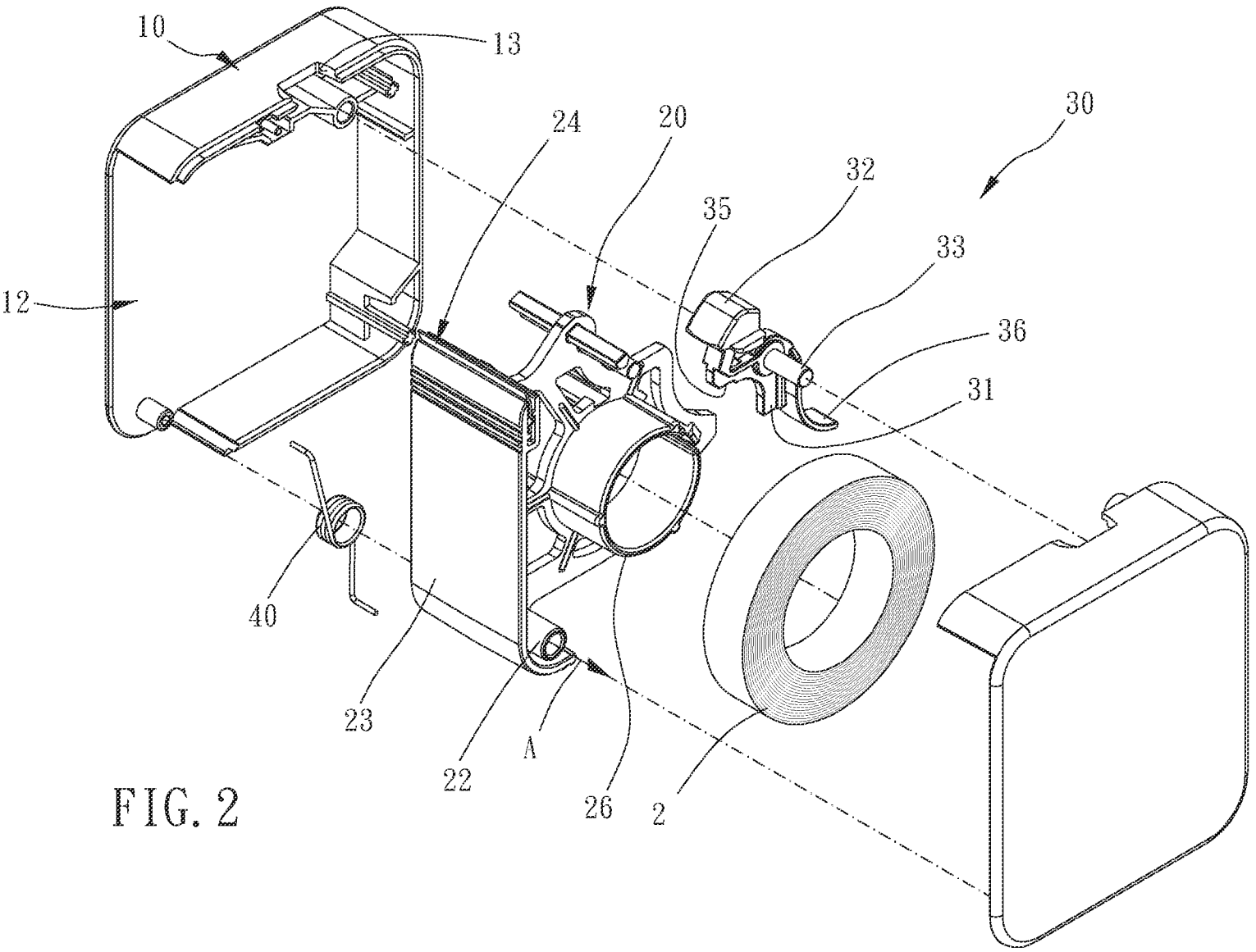
FIG. 2 is a breakdown drawing of a preferable embodiment of the present invention.

Please refer to FIGS. 1 to 7 for a preferable embodiment of the present invention. A tape dispenser 1 of the present invention includes a base 10, a main body 50, a reel member 20, an installation portion 26 and a control portion 30.

Figure 6:
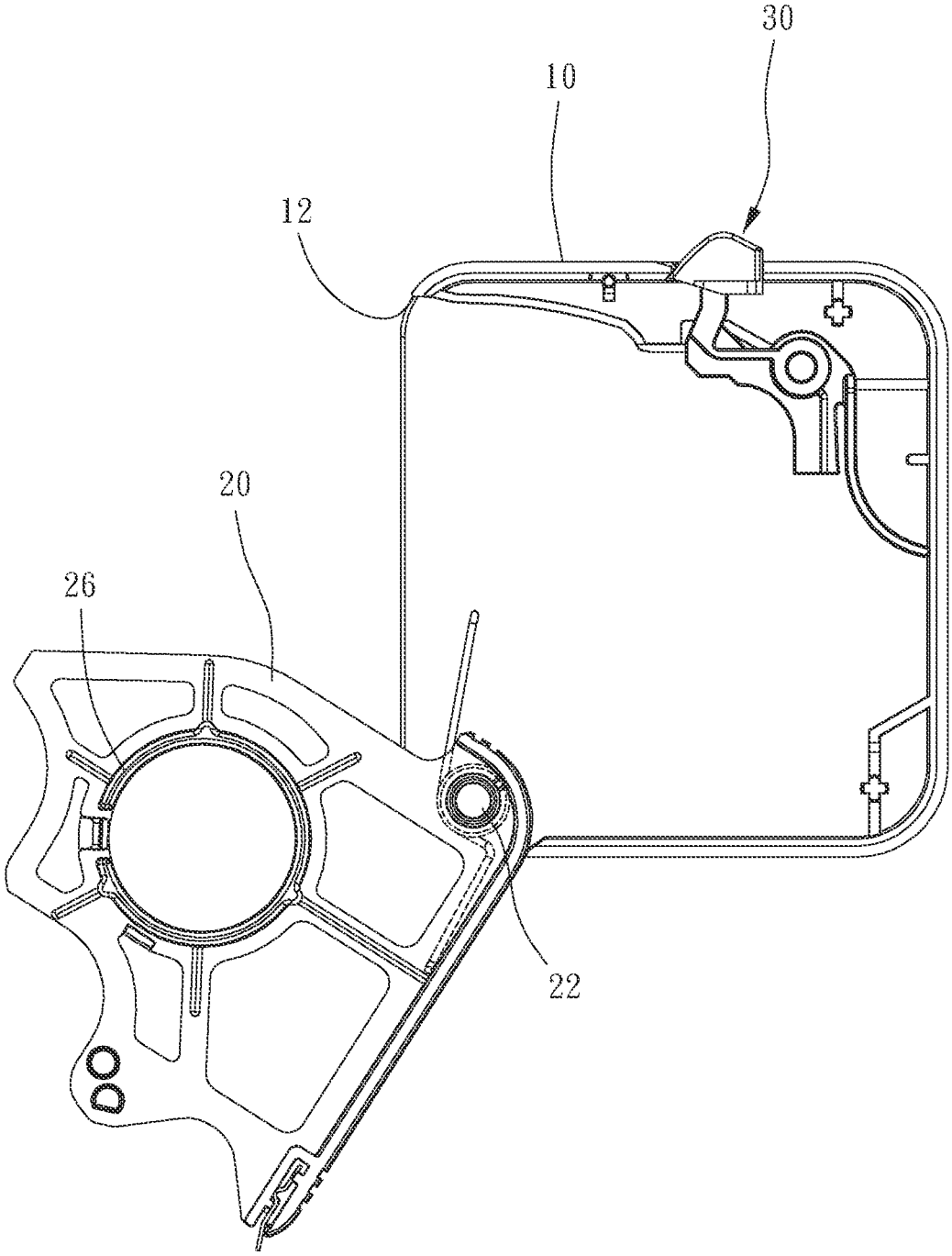

The main body 50 includes the base 10 and the reel member 20, and the reel member 20 is connected to the base 10 and movable between a plurality of positions relative to the base 10. The installation portion 26 is connected to the main body 50, and the installation portion 26 is configured for installation of a tape 2. The control portion 30 is mounted to the base 10. The control portion 30 operates to allow movement of the reel member 20 so that the reel member 20 is restricted to be in one of the plurality of positions, whereby allowing one-hand operation in operating the control portion 30 to change the position of the reel member 20. Specifically, the plurality of positions include an initial position (FIG. 3), the first position (FIG. 7) and the second position (FIG. 6).

Specifically, the base 10 includes a receiving space 11 and an opening 12 in communication with the receiving space 11, the reel member 20 includes the installation portion 26, and the reel member 20 is received in the receiving space 11. When the reel member 20 is located in the initial position or the first position, the installation portion 26 is located in the receiving space 11; and when the reel member 20 is located in the second position, the installation portion 26 is movable to be entirely out of the receiving space 11 from the opening 12. The installation portion 26 of the reel member 20 in the first position is nearer the opening 12 than in the second position. Whereby, the reel member 20 can be restrictedly in one of different positions by operating (such as pressing, sliding or the like) the control portion 30.

The control portion 30 may operate to allow movement of the reel member 20 so that the reel member 20 is switched to and restricted between different neighboring ones of the plurality of positions.

Figure 3:
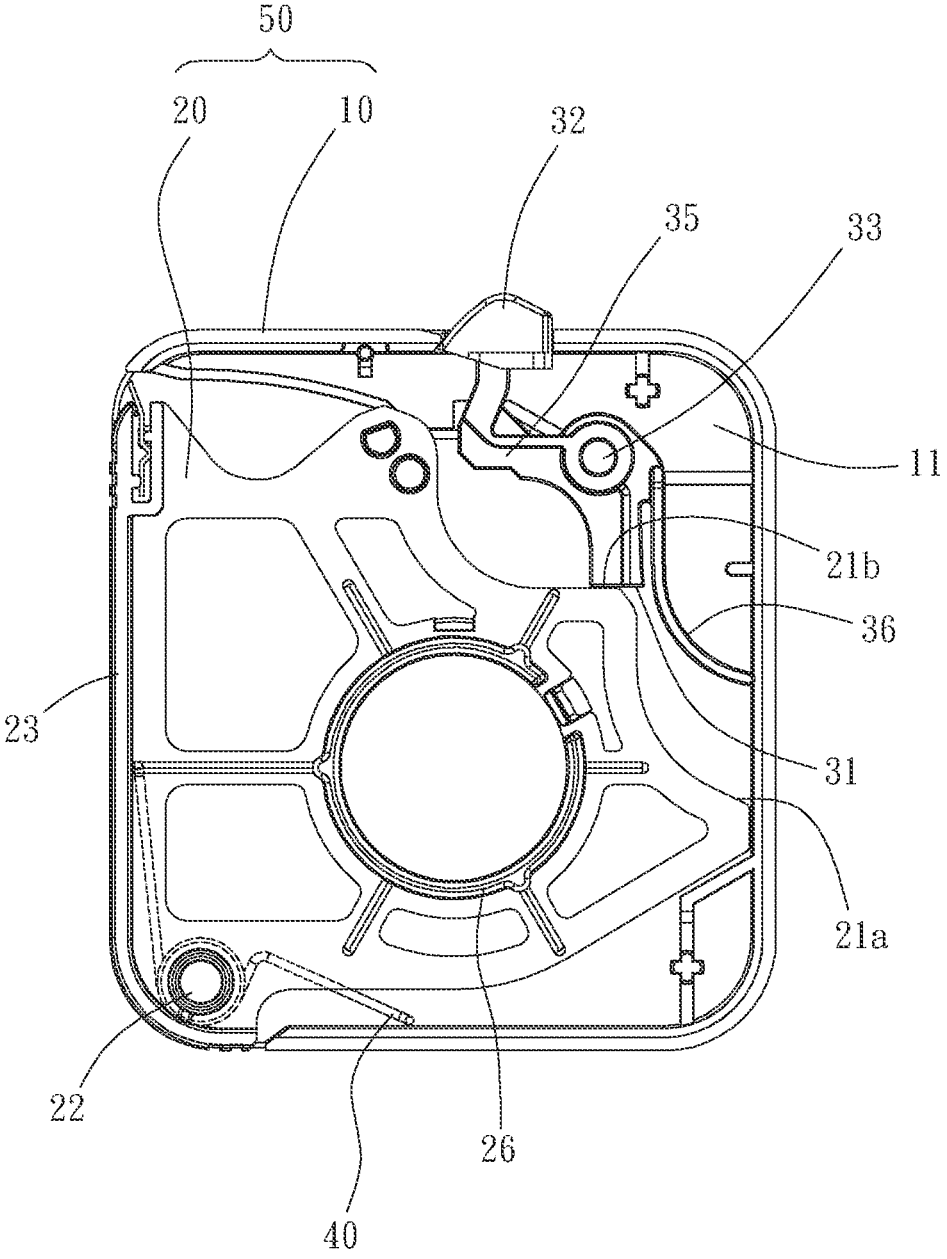
FIG. 3 is a cross-sectional view of a preferable embodiment of the present invention.
Figure 4:
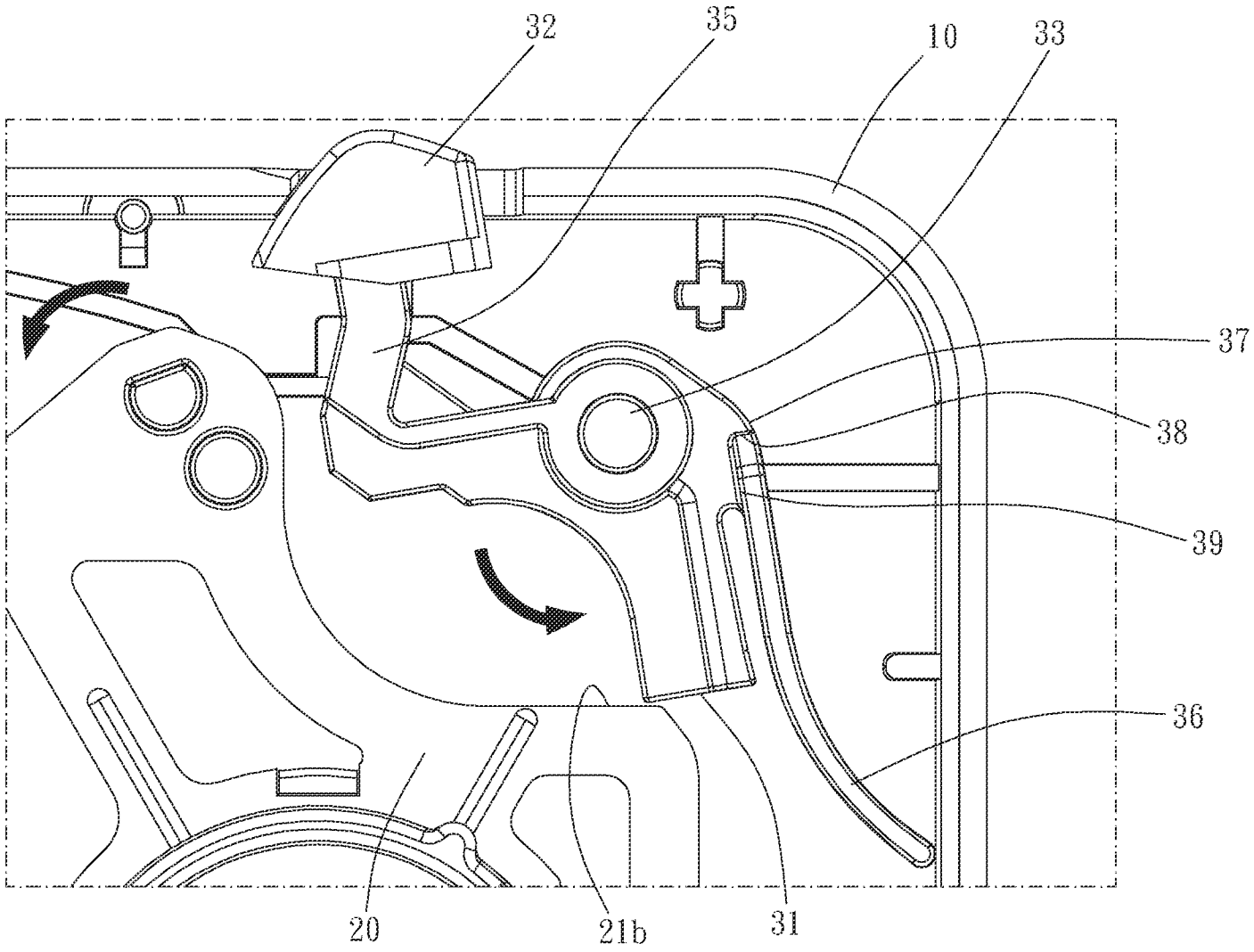
FIG. 4 is a partial enlarged cross-sectional view of a preferable embodiment of the present invention.
Figure 5:
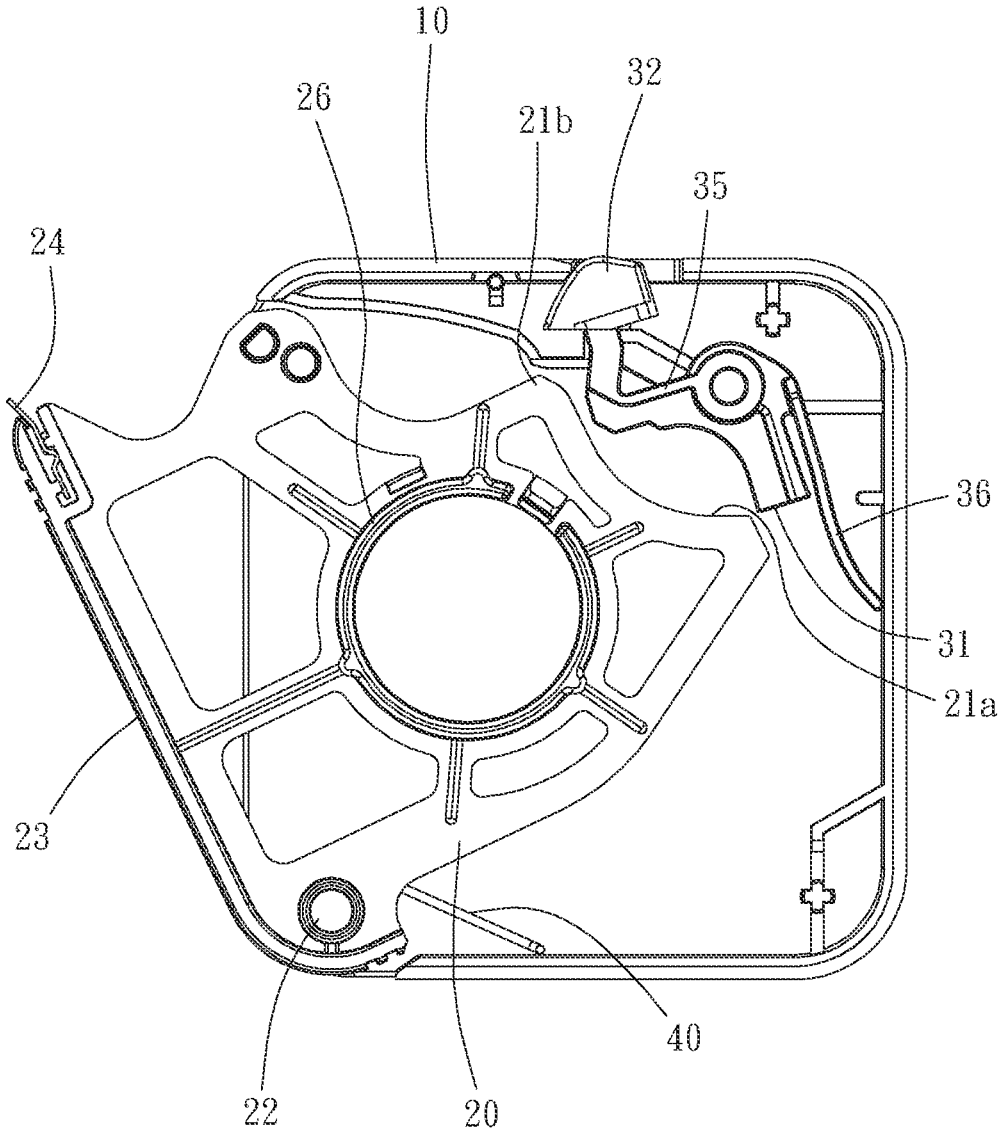
FIGS. 5-7 are drawings showing operation of a preferable embodiment of the present invention.

The control portion 30 includes a blocking portion 31, and the blocking portion 31 is movable between a blocking position (FIGS. 3 and 7) and a dodging position (FIGS. 4 and 5). The reel member 20 includes a plurality of blocked portions 21*a*, 21*b*, and the blocked portion 21*a* is nearer to the opening 12 than the blocked portion 21*b*. Each of the plurality of blocked portions 21*a*, 21*b* is movable with the reel member 20 along a movement path relative to the base 10. When the blocking portion 31 is located in the dodging position, the blocking portion 31 is not blockable with any of the plurality of blocked portions 21*a*, 21*b* so that the reel member 20 can rotate to pass over the blocking portion 31 of the control portion 30 (FIG. 4). When the blocking portion 31 is located in the blocking position, the blocking portion 31 is blockable with one of the plurality of blocked portions 21*a*, 21*b* on the movement path. Specifically, when the reel member 20 is located in the first position, the blocking portion 31 is blocked with the blocked portion 21*a*; and when the reel member 20 is located in the initial position, the blocking portion 31 is blocked with the blocked portion 21*b*.

Figure 7:
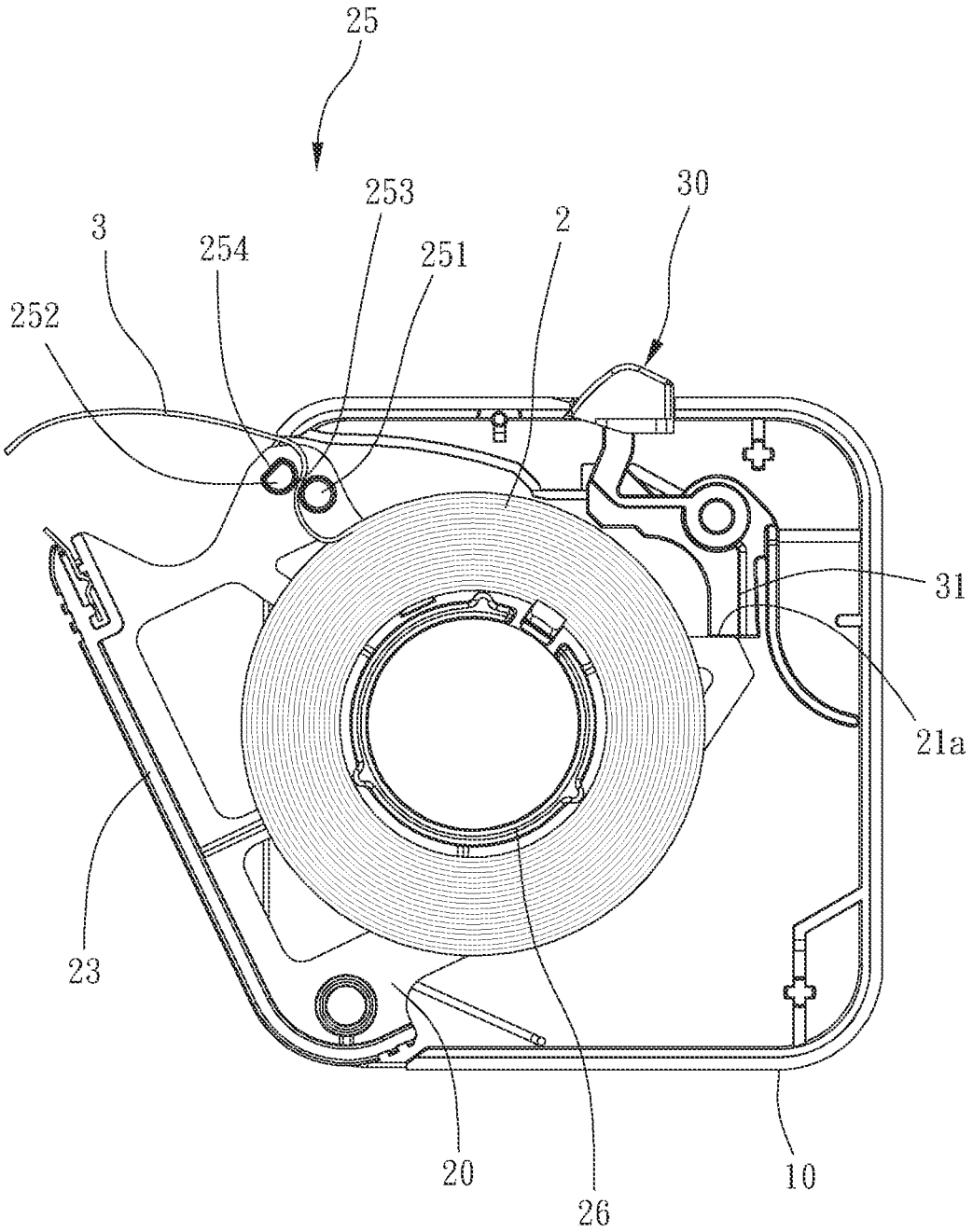

The control portion 30 further includes a press portion 32, the press portion 32 is connected with the blocking portion 31, and the press portion 32 is movable between a press position (FIGS. 4 and 5) and a release position (FIGS. 3 and 7). When the press portion 32 is located in the press position, the press portion 32 is adjacent to the base 10, the blocking portion 31 is located in the dodging position; and when the press portion 32 is located in the release position, the press portion 32 is remote from the base 10, and the blocking portion 31 is located in the blocking position, so that the blocking portion 31 can be released by pressing the press portion 32. The tape dispenser 1 further includes an elastic member 40, and the elastic member 40 is abutted against and between the base 10 and the reel member 20. In this embodiment, the elastic member 40 is a torsion spring, and the elastic member 40 can return the reel member 20.

The control portion 30 further includes an axial member 33 connected with the press portion 32, the blocking portion 31 projects radially from the axial member 33, and the blocking portion 31 is movable with the press portion 32 and swingable relative to the base 10. The control portion 30 further includes a connection section 35 connected with and between the press portion 32 and the axial member 33, and the connection section 35 is L-shaped. The base 10 further includes a through hole 13 in communication with the receiving space 11, the press portion 32 is exposed outside the through hole 13, for easy pressing.

The control portion 30 further includes an elastic portion 36, and the elastic portion 36 is abutted against and between the control portion 30 and the base 10. In this embodiment, the elastic portion 36 is an arcuate plate, and the arcuate plate is made of elastic material. The control portion 30 further includes a projection 37 projects radially outward, the elastic portion 36 is connected with the projection 37, an outer circumferential face of the control portion 30 includes a recess 38 and an abutment face 39 lateral to the projection 37, the projection 37 and the abutment face 39 define the recess 38, an end of the elastic portion 36 is received within the recess 38, and two sides of the elastic portion 36 are abutted against the abutment face 39 and the projection 37, respectively. The elastic portion 36 is abutted against the base 10 so that the control portion 30 can operate and recover smoothly.

The reel member 20 further includes a shaft 22, the reel member 20 is rotatably connected to the base 10 by the shaft 22, the plurality of blocked portions 21*a*, 21*b* are connected with the shaft 22, the shaft 22 extends in an axial direction A, the plurality of blocked portions 21*a*, 21*b* are arranged around the axial direction A, and. each of the plurality of blocked portions 21*a*, 21*b* projects radially relative to the shaft 22.

The reel member 20 further includes a covering portion 23, and the covering portion 23 openably covers the opening 12. When the reel member 20 is located in the initial position, the covering portion 23 covers the opening 12. The reel member 20 further includes a cutting portion 24, the cutting portion 24 is disposed at an end of the covering portion 23, which is easy and safe to use. When the reel member 20 is located in the first position or the second position, the opening 12 is not covered by the covering portion 23. When the reel member 20 is located in the first position, the tape can be dispensed and used; and when the reel member 20 is located in the second position, the installation portion 26 is moved to be entirely out of the receiving space from the opening, which allows replacement of the tape 2.

The reel member 20 further includes a tape guiding mechanism 25, and the tape guiding mechanism 25 is disposed between the installation portion 26 and the cutting portion 24. The tape guiding mechanism 25 includes a first guiding member 251, a second guiding member 252 and a passageway 253 which is defined by the first guiding member 251 and the second guiding member 252 and configured for the tape 2 to pass therethrough, the first guiding member 251 is nearer to the installation portion 26 than the second guiding member 252, and the second guiding member 252 is nearer to the cutting portion 24 than the first guiding member 251. Preferably, the first guiding member 251 and the second guiding member 252 are rod members, and the second guiding member 252 includes a flat side face 254 facing radially. Two sides of a free end 3 of the tape 2 are abutted respectively on the first guiding member 251 and the second guiding member 252, and the free end 3 of the tape 2 is clamped between the base 10 and the cutting portion 24 as the covering portion 23 covers the opening 12. When the opening 12 is not covered by the covering portion 23, the free end 3 of the tape 2 can be dispensed for use.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tape dispenser, including:

a main body, including a base and a reel member, the reel member being connected to the base and movable between a plurality of positions relative to the base;

an installation portion, connected to the main body, configured for installation of a tape; and a control portion, mounted to the base;

wherein the control portion operates to allow movement of the reel member so that the reel member is restricted to be in one of the plurality of positions;

wherein the control portion includes a blocking portion, the blocking portion is movable between a blocking position and a dodging position, the reel member includes a plurality of blocked portions, each of the plurality of blocked portions is movable with the reel member along a movement path relative to the base; when the blocking portion is located in the dodging position, the blocking portion is not blockable with any of the plurality of blocked portions; when the blocking portion is located in the blocking position, the blocking portion is blockable with one of the plurality of blocked portions on the movement path.

2. The tape dispenser of claim 1, wherein the base includes a receiving space and an opening in communication with the receiving space, the reel member includes the installation portion; the plurality of positions include a first position and a second position; when the reel member is located in the first position, the installation portion is located in the receiving space; when the reel member is located in the second position, the installation portion is movable to be entirely out of the receiving space from the opening.

3. The tape dispenser of claim 1, wherein the control portion further includes a press portion, the press portion is connected with the blocking portion, the press portion is movable between a press position and a release position; when the press portion is located in the press position, the press portion is adjacent to the base, and the blocking portion is located in the dodging position; when the press portion is located in the release position, the press portion is remote from the base, and the blocking portion is located in the blocking position; the tape dispenser further includes an elastic member, and the elastic member is abutted against and between the base and the reel member.

4. The tape dispenser of claim 3, wherein the control portion further includes an axial member connected with the press portion, the blocking portion is connected with and projects radially from the axial member, and the blocking portion is movable with the press portion and swingable relative to the base; the control portion further includes an elastic portion, the elastic portion is abutted against and between the control portion and the base; the elastic portion is an arcuate plate; the control portion further includes a projection projects radially outward, the elastic portion is connected with the projection, an outer circumferential face of the control portion includes a recess and an abutment face lateral to the projection, the projection and the abutment face define the recess, an end of the elastic portion is received within the recess, two sides of the elastic portion are abutted against the abutment face and the projection, respectively; the elastic portion is abutted against the base; the control portion further includes a connection section connected with and between the press portion and the axial member, the connection section is L-shaped; the base includes a through hole in communication with the receiving space, and the press portion is exposed outside the through hole; the reel member further includes a shaft, the reel member is rotatably connected to the base by the shaft, the plurality of blocked portions are connected with the shaft, the shaft extends in an axial direction, the plurality of blocked portions are arranged around the axial direction, and each of the plurality of blocked portions projects radially relative to the shaft; the reel member further includes a cutting portion and a tape guiding mechanism, the tape guiding mechanism is disposed between the installation portion and the cutting portion, the tape guiding mechanism includes a first guiding member, a second guiding member and a passageway which is defined by the first guiding member and the second guiding member and configured for the tape to pass therethrough, and the first guiding member is nearer to the installation portion than the second guiding member; the first guiding member and a second guiding member are rod members, and the second guiding member includes a flat side face facing radially; the reel member further includes a covering portion, the covering portion openably covers the opening, and the cutting portion is disposed at an end of the covering portion.

5. The tape dispenser of claim 1, wherein the control portion further includes an axial member and a press portion connected with the axial member, the blocking portion is connected with and projects radially from the axial member, and the blocking portion is movable with the press portion and swingable relative to the base.

6. The tape dispenser of claim 1, wherein the control portion further includes an elastic portion, and the elastic portion is abutted against and between the control portion and the base.

7. The tape dispenser of claim 1, wherein the reel member further includes a shaft, the reel member is rotatably connected to the base by the shaft, the plurality of blocked portions are connected with the shaft, the shaft extends in an axial direction, the plurality of blocked portions are arranged around the axial direction, and each of the plurality of blocked portions projects radially relative to the shaft.

8. The tape dispenser of claim 1, wherein the reel member further includes a cutting portion and a tape guiding mechanism, the tape guiding mechanism is disposed between the installation portion and the cutting portion, the tape guiding mechanism includes a first guiding member, a second guiding member and a passageway which is defined by the first guiding member and the second guiding member and configured for the tape to pass therethrough, and the first guiding member is nearer to the installation portion than the second guiding member.

9. The tape dispenser of claim 8, wherein the first guiding member and a second guiding member are rod members, and the second guiding member includes a flat side face facing radially.

10. A tape dispenser, including:

a main body, including a base and a reel member, the reel member being connected to the base and movable between a plurality of positions relative to the base;

an installation portion, connected to the main body, configured for installation of a tape; and a control portion, mounted to the base;

wherein the control portion operates to allow movement of the reel member so that the reel member is switched to and restricted between different neighboring ones of the plurality of positions;

wherein the control portion includes a blocking portion, the blocking portion is movable between a blocking position and a dodging position, the reel member includes a plurality of blocked portions, each of the plurality of blocked portions is movable with the reel member along a movement path relative to the base; when the blocking portion is located in the dodging position, the blocking portion is not blockable with any of the plurality of blocked portions; when the blocking portion is located in the blocking position, the blocking portion is blockable with one of the plurality of blocked portions on the movement path.

11. The tape dispenser of claim 10, wherein the base includes a receiving space and an opening in communication with the receiving space, the reel member includes the installation portion, the reel member is received in the receiving space; the plurality of positions include an initial position, a first position and a second position; when the reel member is located in the initial position or the first position, the installation portion is located in the receiving space; when the reel member is located in the second position, the installation portion is movable to be entirely out of the receiving space from the opening; the installation portion of the reel member in the first position is nearer the opening than in the second position.

12. The tape dispenser of claim 10, wherein the control portion further includes a press portion, the press portion is connected with the blocking portion, the press portion is movable between a press position and a release position; when the press portion is located in the press position, the press portion is adjacent to the base, and the blocking portion is located in the dodging position; when the press portion is located in the release position, the press portion is remote from the base, and the blocking portion is located in the blocking position; the tape dispenser further includes an elastic member, and the elastic member is abutted against and between the base and the reel member.

13. The tape dispenser of claim 12, wherein the control portion further includes an axial member connected with the press portion, the blocking portion is connected with and projects radially from the axial member, and the blocking portion is movable with the press portion and swingable relative to the base; the control portion further includes an elastic portion, the elastic portion is abutted against and between the control portion and the base; the elastic portion is an arcuate plate; the control portion further includes a projection projects radially outward, the elastic portion is connected with the projection, an outer circumferential face of the control portion includes a recess and an abutment face lateral to the projection, the projection and the abutment face define the recess, an end of the elastic portion is received within the recess, two sides of the elastic portion are abutted against the abutment face and the projection, respectively; the elastic portion is abutted against the base; the control portion further includes a connection section connected with and between the press portion and the axial member, the connection section is L-shaped; the base includes a through hole in communication with the receiving space, and the press portion is exposed outside the through hole; the reel member further includes a shaft, the reel member is rotatably connected to the base by the shaft, the plurality of blocked portions are connected with the shaft, the shaft extends in an axial direction, the plurality of blocked portions are arranged around the axial direction, and each of the plurality of blocked portions projects radially relative to the shaft; the reel member further includes a cutting portion and a tape guiding mechanism, the tape guiding mechanism is disposed between the installation portion and the cutting portion, the tape guiding mechanism includes a first guiding member, a second guiding member and a passageway which is defined by the first guiding member and the second guiding member and configured for the tape to pass therethrough, and the first guiding member is nearer to the installation portion than the second guiding member; the first guiding member and a second guiding member are rod members, and the second guiding member includes a flat side face facing radially; the reel member further includes a covering portion, the covering portion openably covers the opening, and the cutting portion is disposed at an end of the covering portion.

14. The tape dispenser of claim 10, wherein the control portion further includes an axial member and a press portion connected with the axial member, the blocking portion is connected with and projects radially from the axial member, and the blocking portion is movable with the press portion and swingable relative to the base.

15. The tape dispenser of claim 10, wherein the control portion further includes an elastic portion, and the elastic portion is abutted against and between the control portion and the base.

16. The tape dispenser of claim 10, wherein the reel member further includes a shaft, the reel member is rotatably connected to the base by the shaft, the plurality of blocked portions are connected with the shaft, the shaft extends in an axial direction, the plurality of blocked portions are arranged around the axial direction, and each of the plurality of blocked portions projects radially relative to the shaft.

17. The tape dispenser of claim 10, wherein the reel member further includes a cutting portion and a tape guiding mechanism, the tape guiding mechanism is disposed between the installation portion and the cutting portion, the tape guiding mechanism includes a first guiding member, a second guiding member and a passageway which is defined by the first guiding member and the second guiding member and configured for the tape to pass therethrough, and the first guiding member is nearer to the installation portion than the second guiding member.

18. The tape dispenser of claim 17, wherein the first guiding member and a second guiding member are rod members, and the second guiding member includes a flat side face facing radially.

* * * * *